United States Patent [19]

Moor

[11] Patent Number: 4,856,817

[45] Date of Patent: Aug. 15, 1989

[54] EASY GRIP BINDER

[75] Inventor: Marc L. Moor, Dayton, Ohio

[73] Assignee: The Mead Corporation, Dayton, Ohio

[21] Appl. No.: 231,559

[22] Filed: Aug. 12, 1988

[51] Int. Cl.[4] ..... B42D 3/00; B42D 3/02; B42D 3/08; B42F 3/00

[52] U.S. Cl. ..... 281/29; 281/36; 281/37; 402/3

[58] Field of Search ..... 281/29, 36, 37; 402/75, 402/3; 283/42, 38, 37, 36

[56] References Cited

U.S. PATENT DOCUMENTS

| | | | |
|---|---|---|---|
| 1,549,599 | 8/1925 | Mragodanovitch | 281/36 |
| 1,972,048 | 8/1934 | Rennie | 281/37 |
| 2,215,433 | 9/1940 | Trussel | 281/37 |
| 2,233,022 | 2/1941 | Mathers | 281/29 |
| 2,244,175 | 6/1941 | Schade | 281/29 |
| 3,572,957 | 3/1971 | Strassberg | 281/29 |
| 3,877,729 | 4/1975 | Friedman | 281/37 |
| 3,938,831 | 2/1976 | Herman | 281/29 |

*Primary Examiner*—Frank T. Yost
*Assistant Examiner*—Paul M. Heyrana, Sr.
*Attorney, Agent, or Firm*—Biebel, French & Nauman

[57] ABSTRACT

A binder having recesses at both sides of the spine to enable easy grasping for removal from a shelf. The spine recesses also facilitate carrying of the binder. Carrying of the binder is additionally facilitated by a hand-hold recess opposite the spine recesses.

3 Claims, 6 Drawing Sheets

EASY GRIP BINDER

BACKGROUND OF THE INVENTION

This invention relates to binders of the type commonly having snap-ring sheet retainers. Such binders conventionally are constructed from three pieces of straight edge rectangular board joined together at front and rear hinge lines by lamination between an inside cover sheet and an outside cover sheet. These binders have a sharp, angular transition of surface in the spine area, and when they are stood in a row on a shelf or desk they are difficult to grasp. Moreover, this angular surface transition does not interface comfortably in a person's hand when the binder is carried with the spine down. Furthermore, the straight exterior edge opposite the spine does not offer the user an identifiable holding area when the product is carried spine up.

SUMMARY OF THE INVENTION

This invention provides an improved binder having opposed spine recesses for ease of grasping. The binder is constructed in the manner well-known in the prior art and comprises a front cover board, a rear cover board and a spine board positioned between the front cover board and the rear cover board so as to define front and rear hinge lines therebetween. Inside and outside cover sheets are laminated to the spine board and cover boards on opposite sides in the customary manner. The spine recesses are defined by cutouts on opposite sides of the spine board and matching cutouts on the cover boards. The outside cover sheet is depressed conformingly into the cutouts. A hand-hold recess is provided opposite the spine recesses. This latter recess is defined by providing hand-hold cutouts along the edges of the cover boards which are remote from the spine. The inside and outside covers are conformingly fitted into these cutouts. Preferably, the outside cover sheet has a ribbed contour in the region of the spine recesses to facilitate finger gripping.

DESCRIPTION OF THE PREFERRED EMBODIMENT

Figure 1:
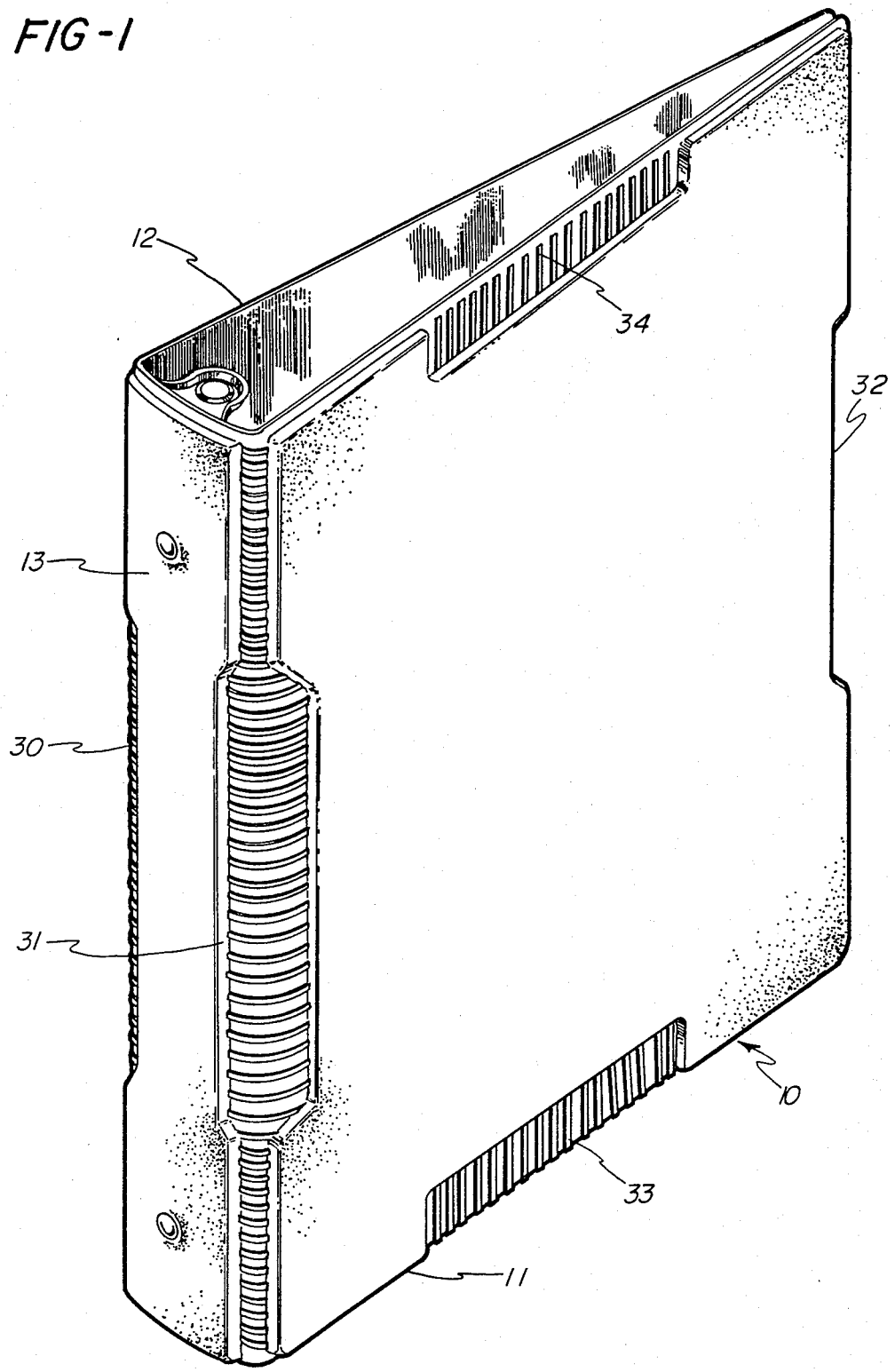
FIG. 1 is a perspective view of the binder of this invention.
Figure 8:
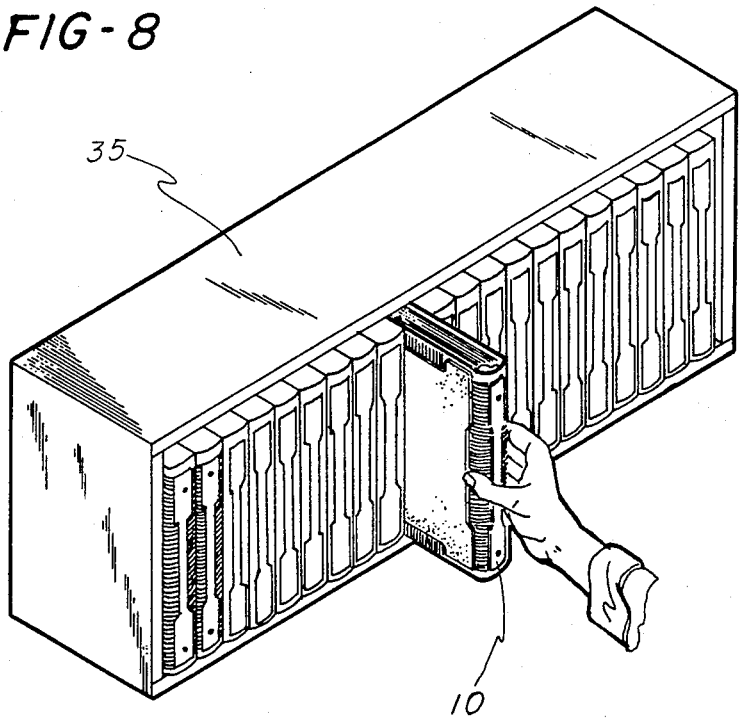
FIG. 8 is an illustration of a series of binders standing on a shelf.

A binder in accordance with the present invention may appear as generally indicated by the reference numeral 10 of FIG. 1. The binder 10 comprises a front cover 11, a rear cover 12 and a spine 13. Binder 10 has a pair of spine recesses 30,31 which enable easy grasping, as illustrated in FIG. 8. As shown in that figure, a series of binders 10 may be stood side-by-side on a shelf

35 with their spine recesses in alignment for easy insertion of the fingers.

Figure 9:
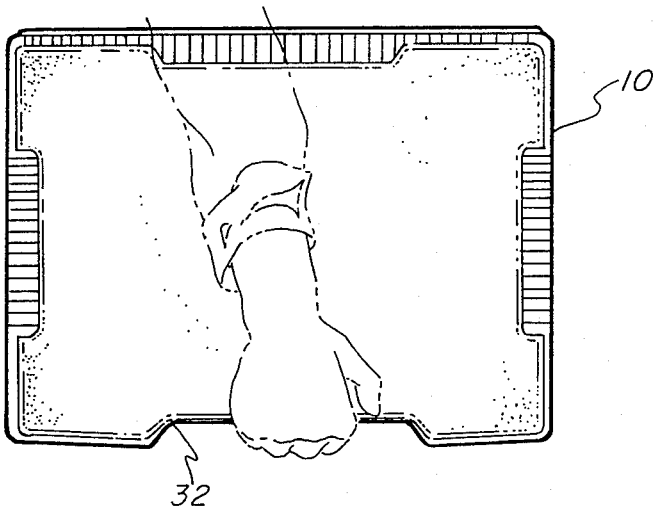
FIG. 9 illustrates the use of a hand-hold recess.

Binder 10 may also be provided with a hand-hold recess 32 to facilitate carrying, as illustrated in FIG. 9. If it is desired to carry binder 10 with the spine side down, then spine recesses 30,31 provide a convenient interface for the hand. Front cover 11 may also be provided with a pair of decorative recesses 33,34.

Figure 2:
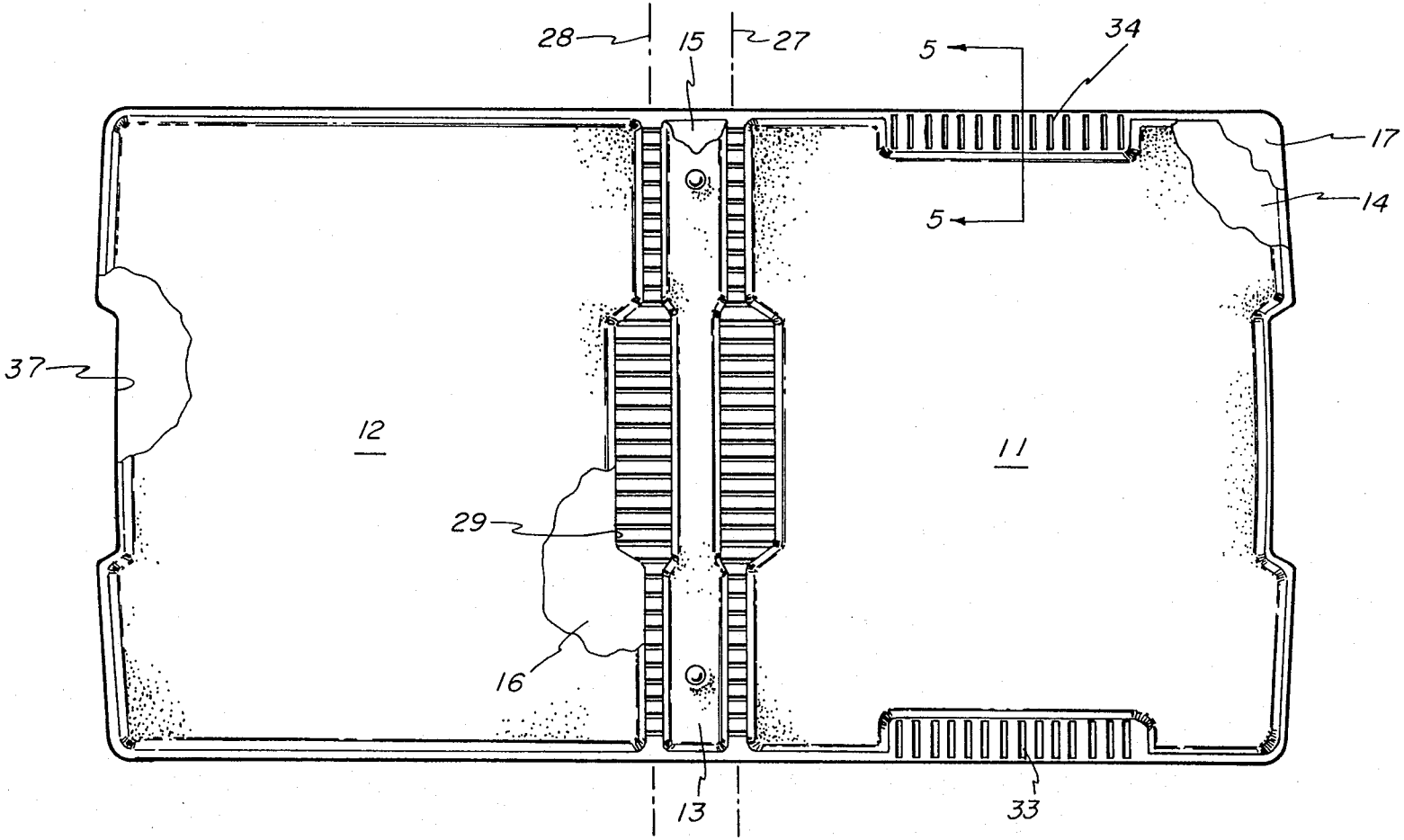
FIG. 2 is an elevation view of a fully opened binder viewed from the outisde.
Figure 3:
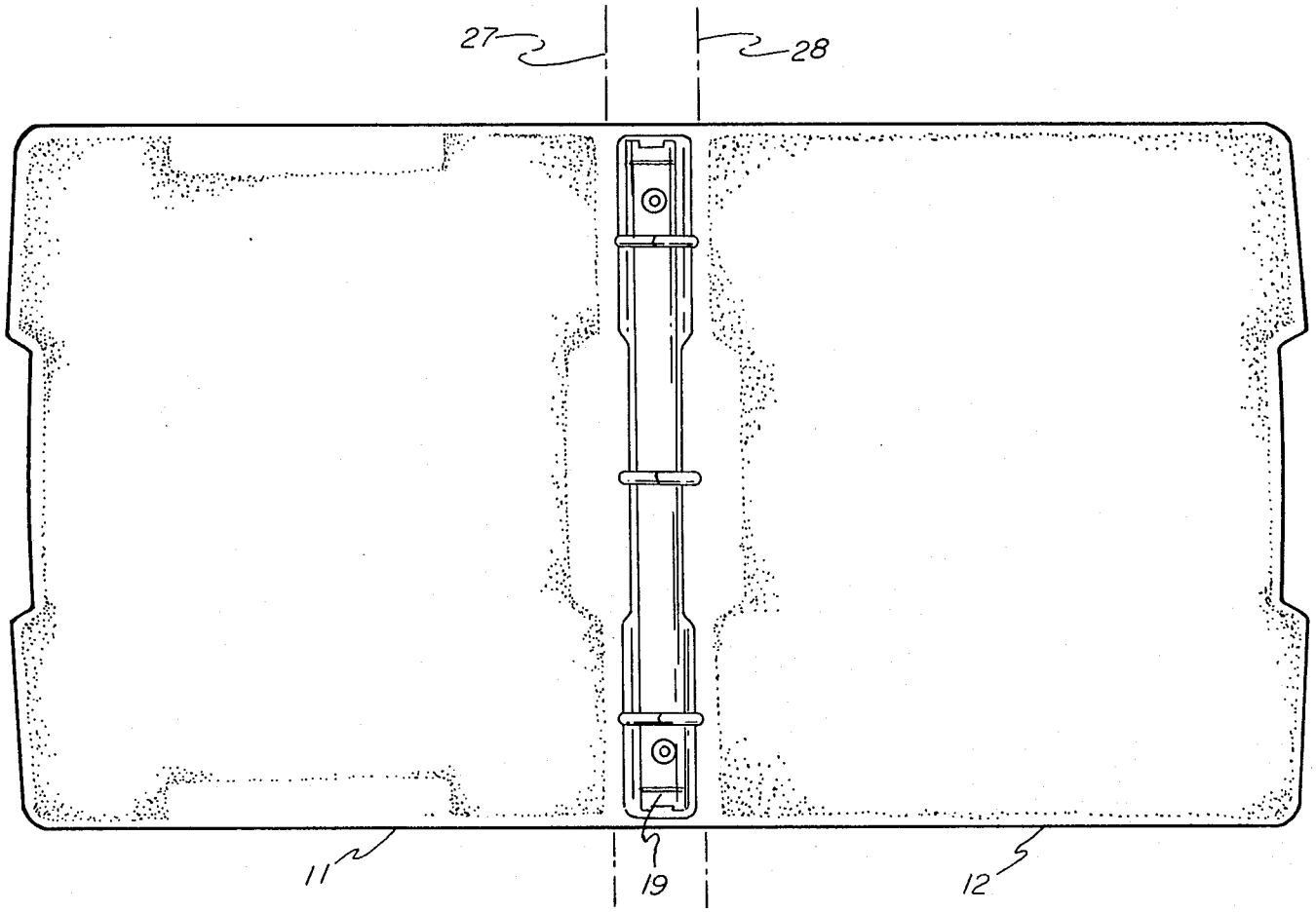
FIG. 3 is an elevation view of a fully opened binder viewed from the inside.
Figure 5:
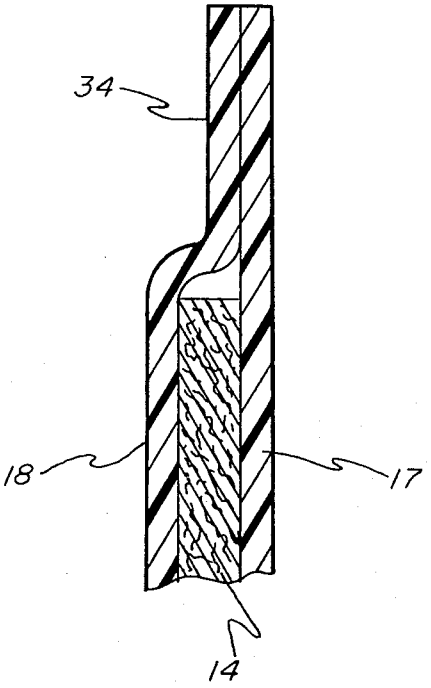
FIG. 5 is an enlarged cross-sectional view taken along lines 5—5 of FIG. 2.
Figure 4:
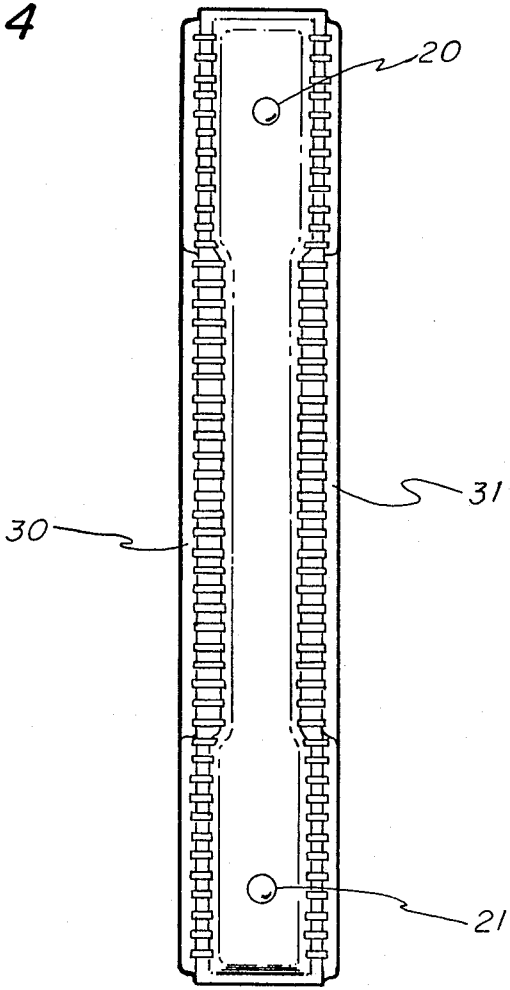
FIG. 4 is side elevation view of a closed binder viewed from the spine side.
Figure 7:
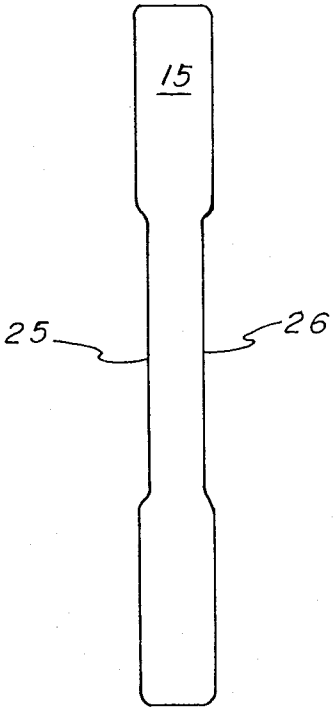
FIG. 7 is an illustration of a spine board.
Figure 6:
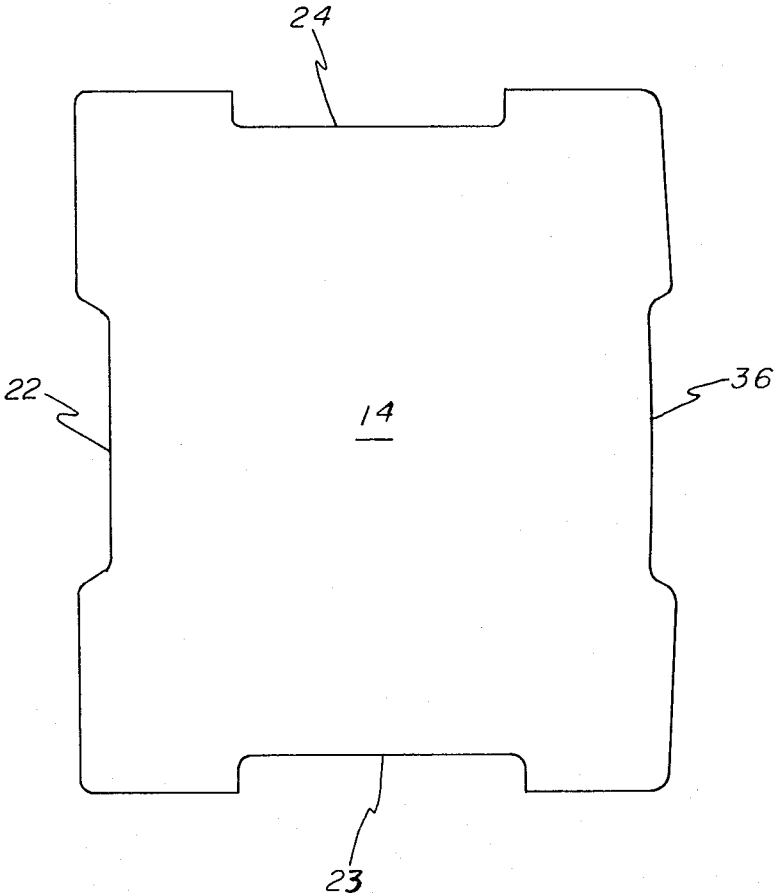
FIG. 6 is an illustration of a front cover board.

As illustrated in FIG. 2, binder 10 comprises a front cover board 14, a spine board 15 and a rear cover board 16 joined together along a pair of hinge lines 27,28. The cover boards and the spine board are laminated between an inside cover sheet 17 and an outside cover sheet 18, as best illustrated in FIG. 5. Cover sheets 17,18 are preferably fabricated fron vinyl plastic which is heat sealed around the edges. The binder is assembled in the flat condition, heat sealed and thereafter bent into the finished orientation. Outside cover sheet 18 is preferably pressure molded to define a ribbed surface in areas which are devoid of cover board or spine board. A snap-ring sheet retainer may be secured to spine 13 by rivets 20,21.

Spine recess 30 is defined by a cutout 25 in spine board 15 and a matching cutout 29 in rear cover board 16. Outside cover sheet 18 is depressed conformingly into these cutouts to define the recess. Spine recess 31 is similarly defined by a cutout 26 in spine board 15 and a matching cutout 22 in front cover board 14. Outside cover sheet 18 is again depressed conformingly into the cutouts.

Hand-hold recess 32 is defined by a pair of hand-hold cutouts 36,37 in cover board 14,16 respectively. Cover sheets 17,18 are heat sealed around the edges of hand-hold cutouts 36,37. It will be observed that hand-hold cutouts 36,37 are in alignment when binder 10 is closed. Front cover board 14 has lower and upper cutouts 23,24 for definition of lower and upper indentations 33,34 respectively.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a binder comprising a front cover board, a rear cover board, a spine board positioned between said front cover board and said rear cover board to define front and rear hinge lines therebetween, said front and rear cover boards and said spine board being joined together by being laminated between an inside cover sheet and an outside cover sheet, the improvement wherein said binder is provided with a pair of opposed spine recesses, each of said spine recesses defined by a medial cutout on said spine board and by a matching medial cutout on said cover board, said outside cover sheet being depressed conformingly into said cutouts.

2. The improvement of claim 1 wherein said cover boards are provided with hand-hold cutouts opposite said matching cutouts and said inside and outside cover sheets are fitted conformingly about said hand-hold cutouts to define a hand-hold recess when said binder is closed.

3. The improvement of claim 2 wherein said outside cover sheet has a ribbed contour in the regions of said spine recesses for facilitating finger gripping.

* * * * *